United States Patent [19]

Anderson

[11] Patent Number: 4,588,444

[45] Date of Patent: May 13, 1986

[54] METHOD FOR CLEANING POLYMERIC CONTACT LENSES

[76] Inventor: Ronald L. Anderson, 7199 Sunbury Rd., Westerville, Ohio 43081

[21] Appl. No.: 596,796

[22] Filed: Apr. 4, 1984

[51] Int. Cl.[4] ..... B08B 3/08

[52] U.S. Cl. ..... 134/2; 134/7; 134/42

[58] Field of Search ..... 134/2, 7, 42; 252/89.1, 252/174.14; 424/49

[56] References Cited

U.S. PATENT DOCUMENTS

| | | | |
|---|---|---|---|
| 2,024,146 | 12/1935 | Crowther | 424/49 |
| 2,128,917 | 9/1938 | Crocker | 424/49 |
| 2,425,984 | 8/1947 | Blackman | 134/7 |
| 3,884,826 | 5/1975 | Phares et al. | 252/106 |
| 3,910,296 | 10/1975 | Karageozian et al. | 134/2 |
| 4,394,179 | 7/1983 | Ellis et al. | 134/7 |

OTHER PUBLICATIONS

Jorgensen, *J. of Prosthetic Dentistry,* "Materials and Methods for Cleaning Dentures", Dec. 1979, vol. 42, No. 6, p. 619.

*Primary Examiner*—Robert Yoncoskie

*Attorney, Agent, or Firm*—Biebel, French & Nauman

[57] ABSTRACT

A process is disclosed for removing calcium containing mucin lipid proteins from polymeric contact lenses. The lenses are lightly rubbed with certain finely divided crystalline powders under light pressure. The finely divided crystalline powder employed has a critical range of particle sizes and consists essentially of sodium chloride, sodium bicarbonate, or a mixture of sodium chloride and sodium bicarbonate. The powder is free of iodide ions and other ions which irritate the human eye when in contact with a polymeric lens. The most preferred powder contains 94 weight % sodium chloride and 6 weight % sodium bicarbonate.

11 Claims, No Drawings

METHOD FOR CLEANING POLYMERIC CONTACT LENSES

BACKGROUND OF THE INVENTION

The development of polymeric contact lenses has broadened considerably the market for contact lenses. With relatively few exceptions, the wearers of such polymeric lenses find them to be more comfortable to wear than the earlier glass contact lenses.

By reason of the polymeric materials from which they are prepared, some users find that their polymeric lenses have a shorter useful life by reason of the development of deposits on the surfaces of and sometimes in the interior of the polymeric lenses. Such deposits are believed to be complex calcium containing mucin lipid proteins. Such deposits initially form on the lens surface. Unless removed, they can penetrate into the interior of the highly hydrated polymeric lens. Such deposits, when they develop, give rise to a number of problems. The deposits cause a change in the wetting angle of the aqueous eye fluids on the surface of the lenses. In addition, the interior lens surfaces become somewhat rough and the lens tends to become uncomfortable for the wearer. As such deposits build up, they cause opaque areas in the lens which interfere somewhat with the wearer's sight.

For the above reason, there is a need in the art for methods and compositions for removing such calcium containing mucin lipid deposits from polymeric lenses.

SUMMARY OF THE INVENTION

It has been discovered that calcium containing mucin lipid proteins can be removed from polymeric contact lenses by lightly contacting said lenses with certain finely divided crystalline powders under light pressure. The finely divided crystalline powder employed for this purpose must have a critical range of particle sizes and must consist essentially of sodium chloride, sodium bicarbonate, or a mixture of sodium chloride and sodium bicarbonate. The powder must be essentially entirely free of iodide and other ions which irritate the human eye when in contact with a polymeric lens.

DETAILED DESCRIPTION OF THE INVENTION

The finely divided crystalline powder employed in the practice of the invention must consist essentially entirely of sodium chloride, or sodium bicarbonate, or a binary mixture of sodium chloride and sodium bicarbonate. The sodium chloride and sodium bicarbonate employed should be highly purified grades that are essentially free of any ions other than the sodium ion, the chloride ion, and the bicarbonate ion. It is particularly important that these materials be free of iodide ions which sometimes are present in commercially sold sodium chloride, such ions being introduced in the form of sodium iodide added to sodium chloride intended for use as a food seasoning. Care must be exercised to avoid having the powder contaminated with bacteria, viruses, and the like.

While sodium bicarbonate can be employed by itself in the practice of the invention, somewhat better results are obtained in using sodium chloride in the practice of the invention. Optimum results are obtained by using mixtures of both sodium chloride and sodium bicarbonate. Where mixtures of the two components are employed, the mixture should contain at least 85 weight % sodium chloride and up to about 15 weight % of the sodium bicarbonate. The preferred mixtures will contain less than about 10 weight % sodium bicarbonate with the balance being sodium chloride. Especially preferred compositions will contain about 4–8 weight % sodium bicarbonate and most optionally about 6 weight % sodium bicarbonate with the balance of the mixture being sodium chloride.

The crystalline powders of the type described above will have a critical range of particle sizes for use in the invention. Essentially, all of the crystalline powder will pass through a 50 mesh screen (U.S. Standard) with at least about 80 weight % of the powder being retained on a 200 mesh screen (U.S. Standard). The particle sizes should be as homogeneous as possible with essentially all of the powder passing through an 80 mesh screen (U.S. Standard) and with essentially all of the crystalline powder being retained on a 200 mesh screen (U.S. Standard).

A preferred grade of sodium chloride is supplied by Diamond Crystal Salt Company under the trade designation FINE PREPARED FLOUR SALT. On a dry basis, the sodium chloride content is 99.95±0.01%. The Sieve analysis of the product is:

| U.S.S. | Percent Retained | | |
|---|---|---|---|
| Mesh | Min. | Avg. | Max. |
| 50 | 0 | 0 | 0 |
| 70 | 0 | 1 | 3 |
| 80 | 0 | 3 | 6 |
| 100 | 11 | 16 | 21 |
| 120 | 24 | 27 | 30 |
| 140 | 20 | 22 | 25 |
| 200 | 14 | 18 | 22 |
| Pan | 7 | 13 | 19 |

The product has a bulk density of 0.94–0.99 gm/ml and a specific surface area about 125 $ft^2/lb$. A minor amount of tricalcium phosphate may be included as an anti-caking agent.

The method of the invention can be carried out by lightly dusting the surface of the polymeric lens with the crystalline powder and lightly rubbing the crystalline powder over the surface of the lens. The pressure can be applied by the cleaner's fingers or by a suitably designed soft filament brush. It frequently is found to be somewhat more convenient to employ the crystalline powder in the form of a slurry in a sterile aqueous medium suitable for use in contact with the polymeric contact lens. Typically, the aqueous medium used as the slurrying medium will be a sterile saline solution (containing dissolved sodium chloride), or an aqueous surfactant solution of the type employed in cleaning polymeric lenses. The slurry medium most conveniently used is a medium of the type conventionally sold for use in a cleaning regimen for such lenses.

The process of the present invention is intended for use in conjunction with and in supplement to conventionally employed cleaning regimens for polymeric lenses. Such processes typically include treatment of the lens with a solution of a surfactant which then is followed by a heat treatment or treatment with a germicide solution. Finally, the lens is normally treated with a sterile saline solution before being reinserted into the eye.

The compositions and methods of the invention can be employed with any of the polymeric lenses presently employed for corrective vision purposes. As is known, many of the so-called soft lenses are fabricated from silicone resins, including silicone/acrylate copolymers. As is also known, the lenses are highly hydrated. The harder polymeric lenses generally are fabricated from methacrylate resins or combinations of silicone and methacrylate resins.

Over a period of several weeks, it was noted by a licensed dispensing optometrist that a number of new users of polymeric lenses were returning to the optometrist and complaining of at least minor eye irritation by use of their polymeric lenses. After first establishing that the users were properly following the prescribed cleaning regimen using a surfactant solution, a germicide solution and a saline rinse, the lenses were examined. It was noted that many of the lenses bore at least a light coating of a water insoluble material established to be a calcium containing mucin lipid protein. These users were provided with a crystalline mixture consisting of 94 weight % of sodium chloride and 6 weight % sodium bicarbonate. The mixture supplied passed through an 80 mesh screen (U.S. Standard) with essentially the entire mixture being retained on a 200 mesh screen (U.S. Standard). The users were directed to slurry the crystalline solution in a sterile saline solution and to lightly rub the exposed surfaces of their lenses with the slurry before following their normal cleaning regimen. After following the modified regimen, the users found that their lenses were more comfortable to use. Examination of the lenses after following the revised regimen showed that the lenses contained no visible deposits of the calcium containing mucin lipid protein.

While the processes and products herein described constitute preferred embodiments of the invention, it is to be understood that the invention is not limited to these precise processes and products, and that changes may be made therein without departing from the scope of the invention which is defined in the appended claims.

What is claimed is:

1. A process for removing calcium containing mucin lipid proteins from polymeric contact lenses which comprises rubbing said lenses with a finely divided crystalling powder; essentially all of said powder passing through a 50 mesh screen (U.S. Standard) with at least about 80 weight % of said powder being retained on a 200 mesh screen (U.S. Standard); said powder consisting essentially entirely of sodium chloride, or sodium bicarbonate, or a binary mixture of sodium chloride and sodium bicarbonate; said powder being essentially entirely free of iodide and other ions which irritate the human eye when in contact with a polymeric contact lens.

2. The process of claim 1 in which the crystalline powder is slurried in a sterile aqueous medium suitable for use in contact with the polymeric contact lens.

3. The process of claim 2 in which the sterile aqueous medium contains a surfactant.

4. The process of claim 2 in which the sterile aqueous medium contains dissolved sodium chloride.

5. The process of claim 1 in which the crystalline powder consists essentially entirely of sodium chloride.

6. The process of claim 1 in which the crystalline powder consists essentially entirely of sodium bicarbonate.

7. The process of claim 1 in which the crystalline powder is an intimate binary physical admixture of sodium chloride and sodium bicarbonate.

8. The process of claim 7 in which said binary admixture contains at least 85 weight % sodium chloride and up to about 15 weight % sodium bicarbonate.

9. The process of claim 8 in which the binary admixture contains less than about 10 weight % sodium bicarbonate and the balance sodium chloride.

10. The process of claim 9 in which the binary admixture contains about 4–8 weight % sodium bicarbonate.

11. The process of claim 10 in which the binary admixture contains about 6 weight % sodium bicarbonate.

* * * * *